US011491542B2

(12) United States Patent
Pan et al.

(10) Patent No.: US 11,491,542 B2
(45) Date of Patent: Nov. 8, 2022

(54) RAPID INFILTRATION OF DRILL BIT WITH MULTIPLE BINDER FLOW CHANNELS

(71) Applicant: Halliburton Energy Services, Inc., Houston, TX (US)

(72) Inventors: Yi Pan, The Woodlands, TX (US); Daniel Brendan Voglewede, Spring, TX (US); Grant O. Cook, III, Spring, TX (US); Jeffrey G. Thomas, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 96 days.

(21) Appl. No.: 16/627,879

(22) PCT Filed: Aug. 16, 2017

(86) PCT No.: PCT/US2017/047226
§ 371 (c)(1),
(2) Date: Dec. 31, 2019

(87) PCT Pub. No.: WO2019/035829
PCT Pub. Date: Feb. 21, 2019

(65) Prior Publication Data

US 2020/0164441 A1 May 28, 2020

(51) Int. Cl.

| | |
|---|---|
| ***B22F 5/00*** | (2006.01) |
| ***B22D 19/06*** | (2006.01) |
| ***E21B 10/42*** | (2006.01) |

(52) U.S. Cl.
CPC ..... *B22F 5/00* (2013.01); *B22D 19/06* (2013.01); *E21B 10/42* (2013.01);
(Continued)

(58) Field of Classification Search
CPC ..... B22F 2005/001; B22F 5/007; B22D 19/06
See application file for complete search history.

(56) References Cited

U.S. PATENT DOCUMENTS 4,949,598 A * 8/1990 Griffin ..... B22F 3/1208 419/36
3,047,260 A1 11/2011 Uno et al.
(Continued)

OTHER PUBLICATIONS

ISRWO International Search Report and Written Opinion for PCT/US2017/047226 dated Feb. 26, 2018.

*Primary Examiner* — Cathleen R Hutchins
(74) *Attorney, Agent, or Firm* — Thomas Rooney; C. Tumey Law Group PLLC

(57) ABSTRACT

A system for fabricating an infiltrated downhole tool for introduction into a wellbore includes a mold assembly including a binder bowl, a mold, a preformed blank, and a funnel. The binder bowl has a lower portion and a plurality of apertures extending through the lower portion. The preformed blank is disposed within the infiltration chamber to provide an attachment area for a body of the infiltrated downhole tool, and the funnel is disposed intermediate the binder bowl and the mold. The system further includes a binder flow channel which extends through at least one of the preformed blank, the funnel, or a displacement core disposed within the mold assembly, the blank being concentrically arranged around the displacement core.

19 Claims, 5 Drawing Sheets

(52) U.S. Cl.
CPC ..... *B22F 2005/001* (2013.01); *B22F 2998/10* (2013.01); *B22F 2999/00* (2013.01)

(56) References Cited

U.S. PATENT DOCUMENTS

| | | | |
|---|---|---|---|
| 2008/0028891 | A1 | 2/2008 | Calnan et al. |
| 2010/0278604 | A1 | 11/2010 | Glass et al. |
| 2010/0320004 | A1 | 12/2010 | Deng et al. |
| 2014/0069601 | A1 | 3/2014 | Thomas et al. |
| 2016/0318101 | A1 | 11/2016 | Cook, III |

* cited by examiner

RAPID INFILTRATION OF DRILL BIT WITH MULTIPLE BINDER FLOW CHANNELS

TECHNICAL FIELD

The present disclosure generally relates to formation of downhole tools, and more specifically, to systems and methods for rapid infiltration during formation of downhole tools.

BACKGROUND

A variety of downhole tools are commonly used in the exploration and production of hydrocarbons. Examples of such downhole tools include cutting tools, such as drill bits, reamers, stabilizers, and coring bits; drilling tools, such as rotary steerable devices and mud motors; and other downhole tools, such as window mills, packers, tool joints, and other wear-prone tools. Rotary drill bits are often used to drill wellbores. One type of rotary drill bit is a fixed cutter drill bit that has a bit body comprising matrix and reinforcement materials, i.e., a "matrix drill bit" as referred to herein. Matrix drill bits usually include cutting elements or inserts positioned at selected locations on the exterior of the matrix bit body. Fluid flow passageways are formed within the matrix bit body to allow communication of drilling fluids from associated surface drilling equipment through a drill string or drill pipe attached to the matrix bit body.

Matrix drill bits are typically manufactured by placing powder material into a mold and infiltrating the powder material with a binder material, such as a metallic alloy. The various features of the resulting matrix drill bit, such as blades, cutter pockets, and/or fluid-flow passageways, may be manufactured by using a specially shaped mold cavity and/or by positioning temporary displacement materials within interior portions of the mold cavity. A preformed bit blank may be placed within the mold cavity to provide reinforcement for the matrix bit body and to allow attachment of the resulting matrix drill bit with a drill string. A quantity of matrix reinforcement material (typically in powder form) may then be placed within the mold cavity with a quantity of the binder material.

Once these steps are performed, the mold can then be placed within a furnace and the temperature of the mold is increased to a desired temperature to allow the binder (e.g., metallic alloy) to liquefy and infiltrate the matrix reinforcement material. The furnace typically maintains this desired temperature to the point that the infiltration process is deemed complete, such as when a specific location in the bit reaches a certain temperature.

In a conventional mold assembly, during forming of an infiltrated downhole tool, binder material is channeled from a top area of the mold assembly toward the bottom of the mold assembly to infiltrate powder reinforcement material contained in the bottom of the mold assembly. The time for the binder material to completely infiltrate to the bottom of the mold assembly depends in part on the overall depth of the reinforcement material within the mold and any interactions taking place between the binder material and the interface of the blank and the powder reinforcement material. Once the designated process time or temperature has been reached, the mold containing the infiltrated matrix bit is removed from the furnace.

BRIEF DESCRIPTION OF THE DRAWINGS

The following figures are included to illustrate certain embodiments of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
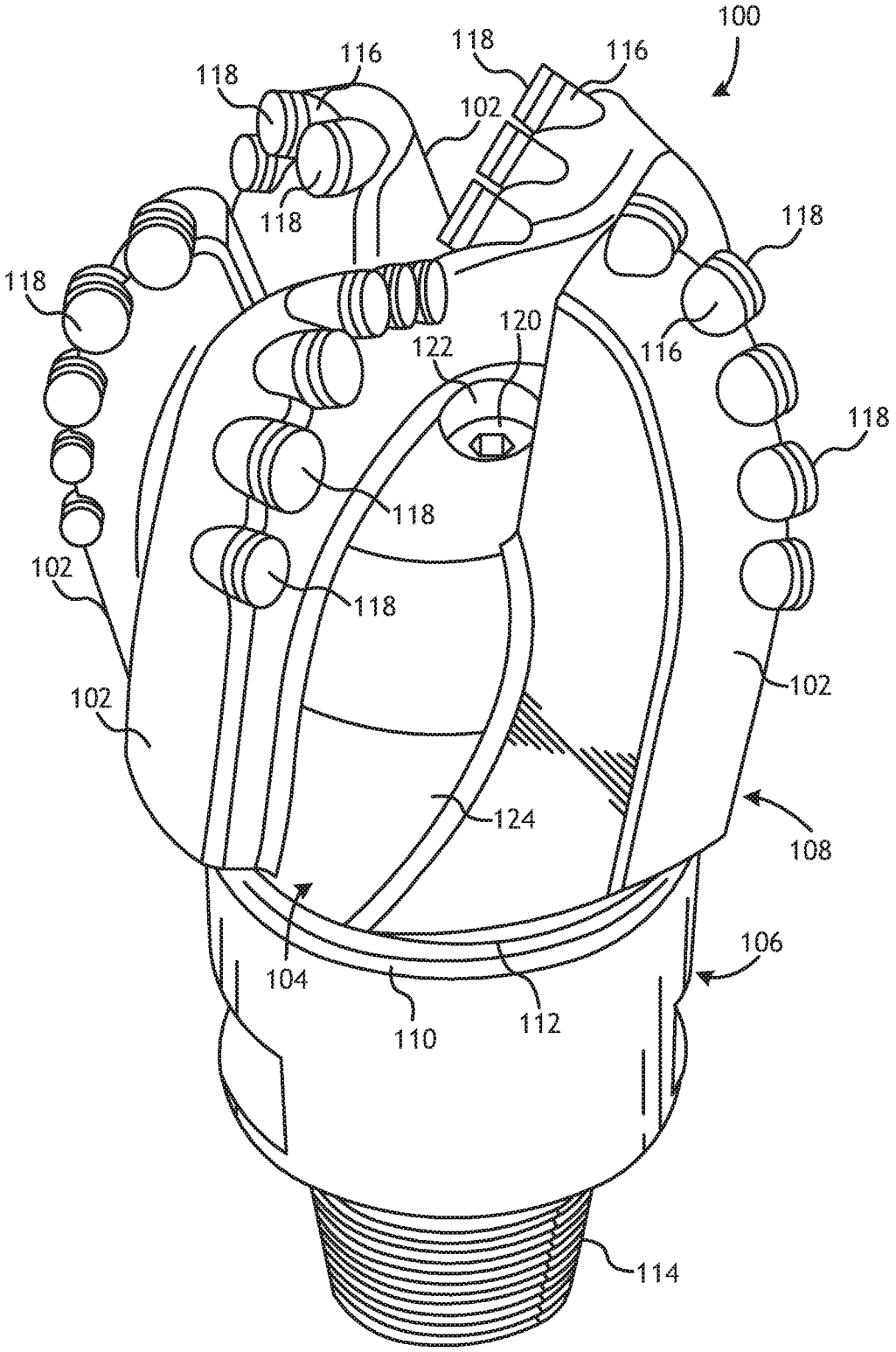
FIG. 1 is a perspective view of a fixed cutter drill bit that may be fabricated in accordance with the principles of the present disclosure, according to some embodiments.

The present disclosure relates to tool manufacturing and, more particularly, to systems and methods for performing rapid infiltration in the formation of downhole tools.

Various embodiments of the present disclosure are directed to providing systems and methods for performing rapid infiltration of matrix reinforcement materials with binder materials during formation of downhole tools.

In accordance with at least some embodiments disclosed herein is the realization that in a conventional mold assembly, the time for the binder material to completely infiltrate to the bottom of the mold assembly depends in part on the overall depth of the reinforcement material and any interactions taking place between the binder material and the interface of the blank and the powder reinforcement material. The greater the length of the downhole tool to be formed, e.g., the length of a blade of a drill bit to be formed, the longer the time necessary for the binder material to infiltrate the matrix powder reinforcement material. This can be problematic in some cases.

For example, the longer the infiltration time, the greater the possibility for adverse reactions to occur between the metal blank used to form the downhole tool and the binder material. Such adverse reactions between the binder material and the interface of the blank and the powder reinforcement material result in formation of a brittle interface between the blank and the powder reinforcement material of the downhole tool.

In particular, in accordance with at least some embodiments disclosed herein is the realization that as the binder material travels from the top of the mold assembly, through the blank, chemical reactions taking place between the binder material and the blank at the interface between the blank and the powder reinforcement material may result in poor metallurgical bonding and/or brittleness of the formed bit body at the interface between the bit blank and the reinforcement powder, which can result in the formation of cracks within the bit body that can be difficult or impossible to inspect. When such defects are present and/or detected, the drill bit is often scrapped during or following manufacturing assuming they cannot be remedied. Every effort is made to detect these defects and reject any defective drill bit component during manufacturing to help ensure that the drill bits used in a job at a well site will not prematurely fail and to minimize any risk of possible damage to the well.

Thus, the present disclosure addresses these and other problems and provides improved manufacturing methods, for example, that can decrease the time it takes for infiltration of the binder materials with the matrix reinforcement materials to occur. This may prove advantageous in preventing or otherwise mitigating the occurrence of some defects that commonly occur in infiltrated downhole tools, such as bond-line and nozzle cracking. Among other things, this may improve quality and reduce the rejection rate of drill bit components due to defects during manufacturing.

FIG. 1 illustrates a perspective view of an example fixed cutter drill bit 100 that may be fabricated in accordance with the principles of the present disclosure. It should be noted that, while FIG. 1 depicts a fixed cutter drill bit 100, the principles of the present disclosure are equally applicable to any type of downhole tool that may be formed or otherwise manufactured through an infiltration process. For example, suitable infiltrated downhole tools that may be manufactured in accordance with the present disclosure include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters, cutting elements), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, washover tools, rotors, stators and/or housings for downhole drilling motors, blades and housings for downhole turbines, and other downhole tools having complex configurations and/or asymmetric geometries associated with forming a wellbore.

As illustrated in FIG. 1, the fixed cutter drill bit 100 may include or otherwise define a plurality of cutter blades 102 arranged along the circumference of a bit head 104. The bit head 104 is connected to a shank 106 to form a bit body 108. The shank 106 may be connected to the bit head 104 by welding, such as using laser arc welding that results in the formation of a weld 110 around a weld groove 112. The shank 106 may further include or otherwise be connected to a threaded pin 114, such as an American Petroleum Institute (API) drill pipe thread.

In the depicted example, the drill bit 100 includes five cutter blades 102, in which multiple recesses or pockets 116 are formed. Cutting elements 118 may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a drill string (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each adjacent pair of cutter blades 102. Cuttings, downhole debris, formation fluids, drilling fluid, etc., may pass through the junk slots 124 and circulate back to the well surface within an annulus formed between exterior portions of the drill string and the inner wall of the wellbore being drilled.

Figure 2B:
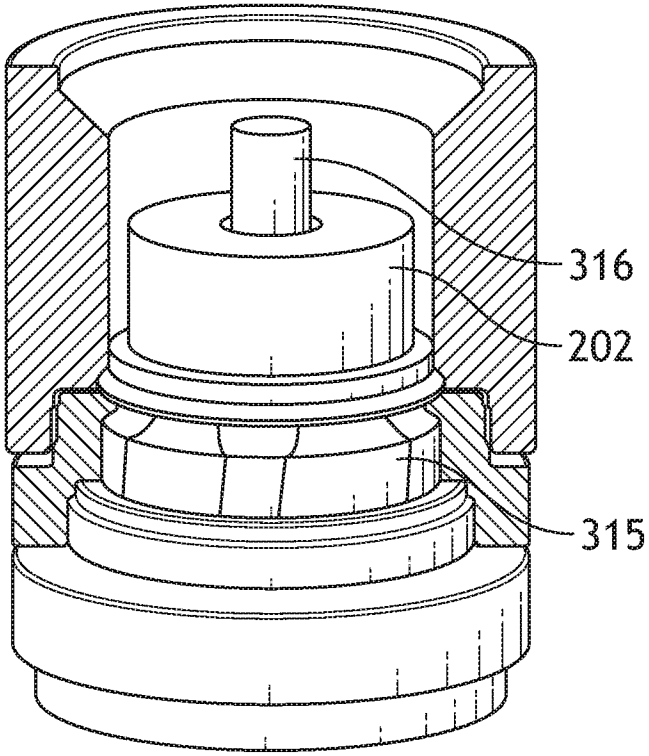
FIG. 2B is a partial, cross-sectional view of the mold assembly of FIG. 2A, according to some embodiments.
Figure 2A:
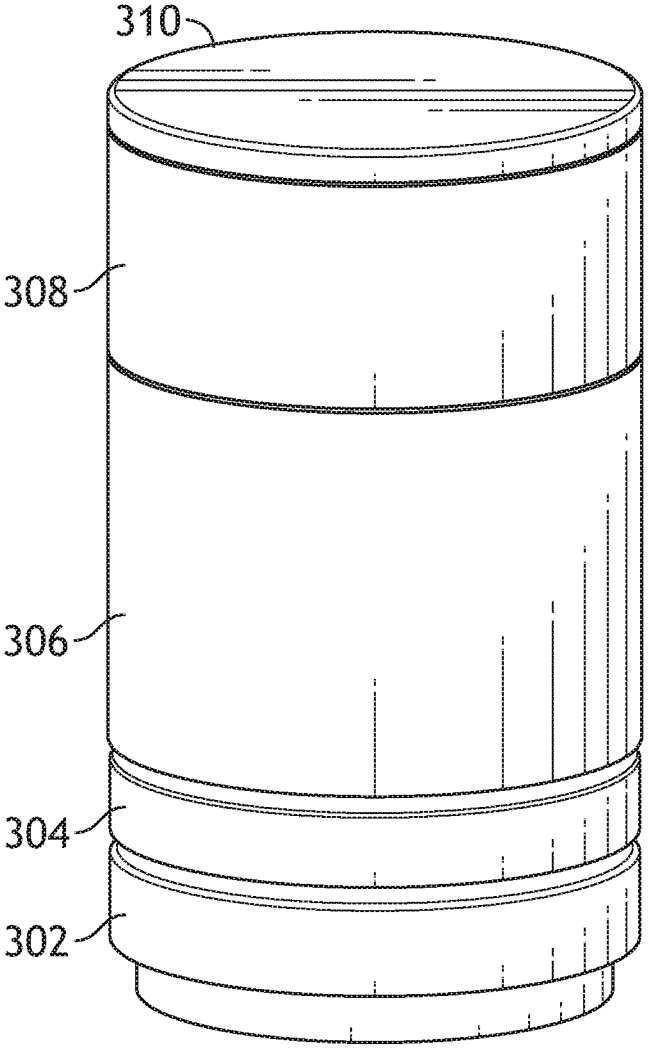
FIG. 2A is a perspective view of a mold assembly for use in forming the drill bit of FIG. 1, according to some embodiments.

FIG. 2A is a perspective view of an exemplary mold assembly 200 for use in forming the drill bit 100 of FIG. 1. FIG. 2B is a partial, cross-sectional view of the exemplary mold assembly of FIG. 2A, and FIG. 3 is a cross-sectional view of the exemplary mold assembly of FIG. 2A.

Figure 3:
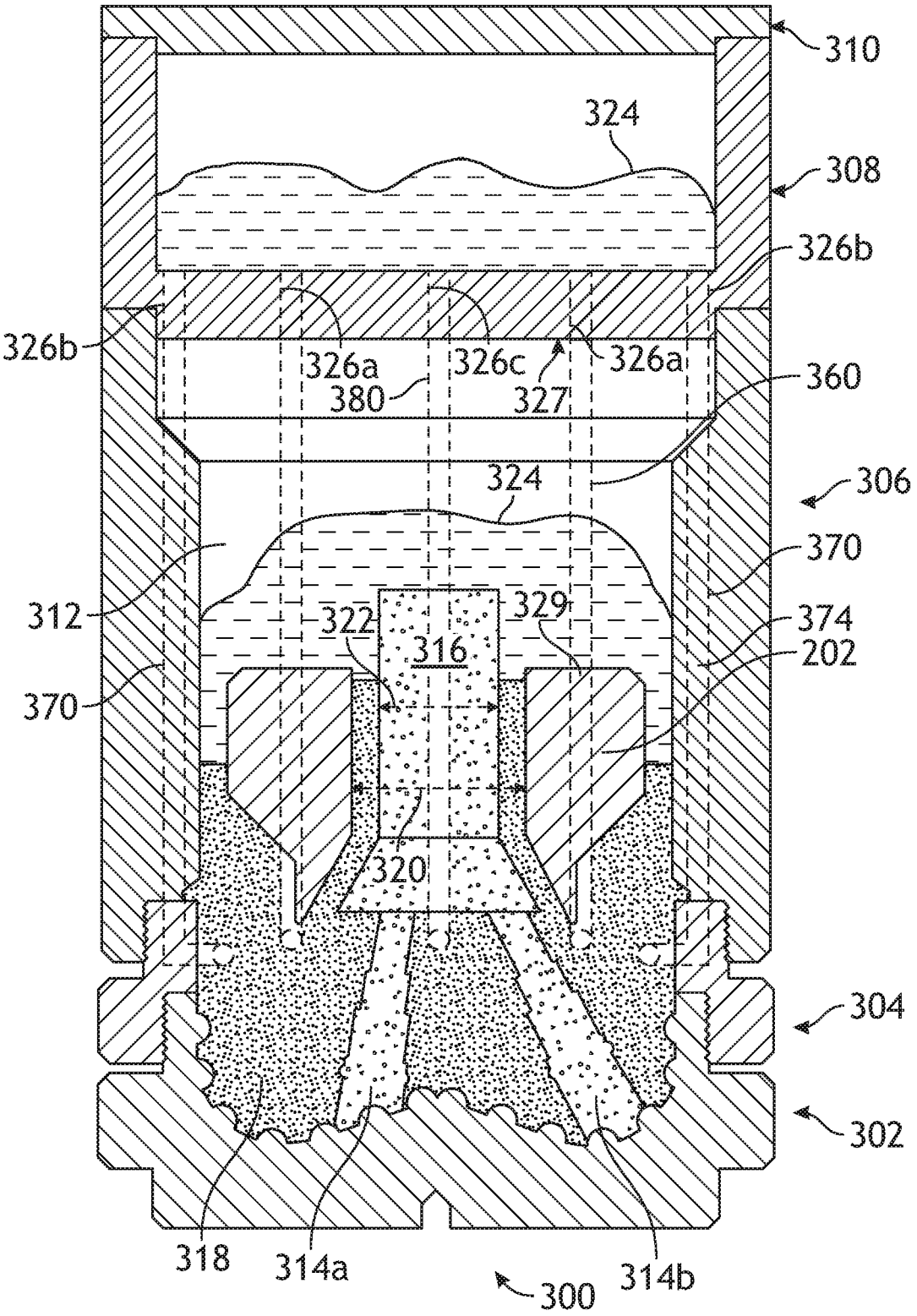
FIG. 3 is a cross-sectional view of the mold assembly of FIG. 2A, according to some embodiments.

Similar numerals from FIG. 1 that are used in FIGS. 2A, 2B, and 3, refer to similar components that are not described again. In some embodiments, a system for fabricating an infiltrated downhole tool 100 for introduction into a wellbore includes a mold assembly 300 which defines an infiltration chamber 312 to receive and contain powder reinforcement material 318 and a binder material 324 used to form the infiltrated downhole tool 100. While the mold assembly 300 is shown and discussed as being used to help fabricate the drill bit 100, those skilled in the art will readily appreciate that mold assembly 300 and its several variations described herein may be used to help fabricate any of the infiltrated downhole tools mentioned above, without departing from the scope of the disclosure.

As illustrated, the mold assembly 300 may include several components such as a mold 302, a gauge ring 304, and a funnel 306. In some embodiments, the funnel 306 may be operatively coupled to the mold 302 via the gauge ring 304, such as by corresponding threaded engagements, as illustrated. In some embodiments, the gauge ring 304 may be omitted from the mold assembly 300 and the funnel 306 may be instead be operatively coupled directly to the mold 302, such as via a corresponding threaded engagement, without departing from the scope of the disclosure.

FIG. 3 is a cross-sectional view of the exemplary mold assembly of FIG. 2A. As illustrated in FIGS. 2A-3, the mold assembly 300 includes a binder bowl 308 having a lower portion 327 and a plurality of apertures 326*a*, 326*b*, 326*c* extending through the lower portion 327. The mold assembly 300 further includes a mold 302 defining a cavity disposed below the binder bowl 308 and configured to receive the powder reinforcement material 318 and permit infiltration of the powder reinforcement material 318 with the binder material 324.

In some embodiments, the mold assembly 300 may further include a funnel disposed intermediate the binder bowl and the mold for defining a perimeter of the downhole tool 100 to be formed, and a cap 310 placed above the binder bowl 308. The mold 302, the gauge ring 304, the funnel 306, the binder bowl 308, and the cap 310 may each be made of or otherwise comprise graphite or alumina ($Al_2O_3$), for example, or other suitable materials. Moreover, one or more junk slot displacements 315 may also be positioned within the mold assembly 300 to correspond with the junk slots 124 (FIG. 1). Various techniques may be used to manufacture the mold assembly 300 and its components including, but not limited to, machining graphite blanks to produce the various components and thereby define the infiltration chamber 312 to exhibit a negative or reverse profile of desired exterior features of the drill bit 100 (FIGS. 1 and 2).

In some embodiments, the mold assembly 300 further includes a preformed metal blank 202 that is disposed within the infiltration chamber 312 to provide reinforcement for the body 108 of the resulting infiltrated downhole tool 100. The metal blank 202 may be supported at least partially by the powder reinforcement materials 318 within the infiltration chamber 312. The blank 202 can provide a pattern or material that can have facilitate the creation of reliable threads for connecting to the drill string.

A first binder flow channel 360 may extend from below a first aperture 326*a* of the plurality of apertures in the binder bowl 308, and through the preformed blank 202 in the infiltration chamber 312. In some embodiments, the first binder flow channel may be formed by drilling a hole 329 through the blank 202, and flowing binder material directly through the hole 329. In some embodiments, first binder flow channel 360 may be formed by placing a metal or ceramic tube or piping in the hole 329 formed in the blank 202 so as to separate the binder material flowing in the first binder flow channel 360 from the blank 202. The first binder flow channel 360 may thus be formed of a metal or ceramic tubing having an impermeable structure that substantially prevents the binder material from intermixing and reacting with the blank as the binder material flows from the binder bowl 308 to the infiltration chamber 312 for reaction with the reinforcement material 318. In some embodiments however, the first binder flow channel 360 may comprise portions that are permeable and other portions that are impermeable, without departing from the scope of the disclosure.

Figure 4:
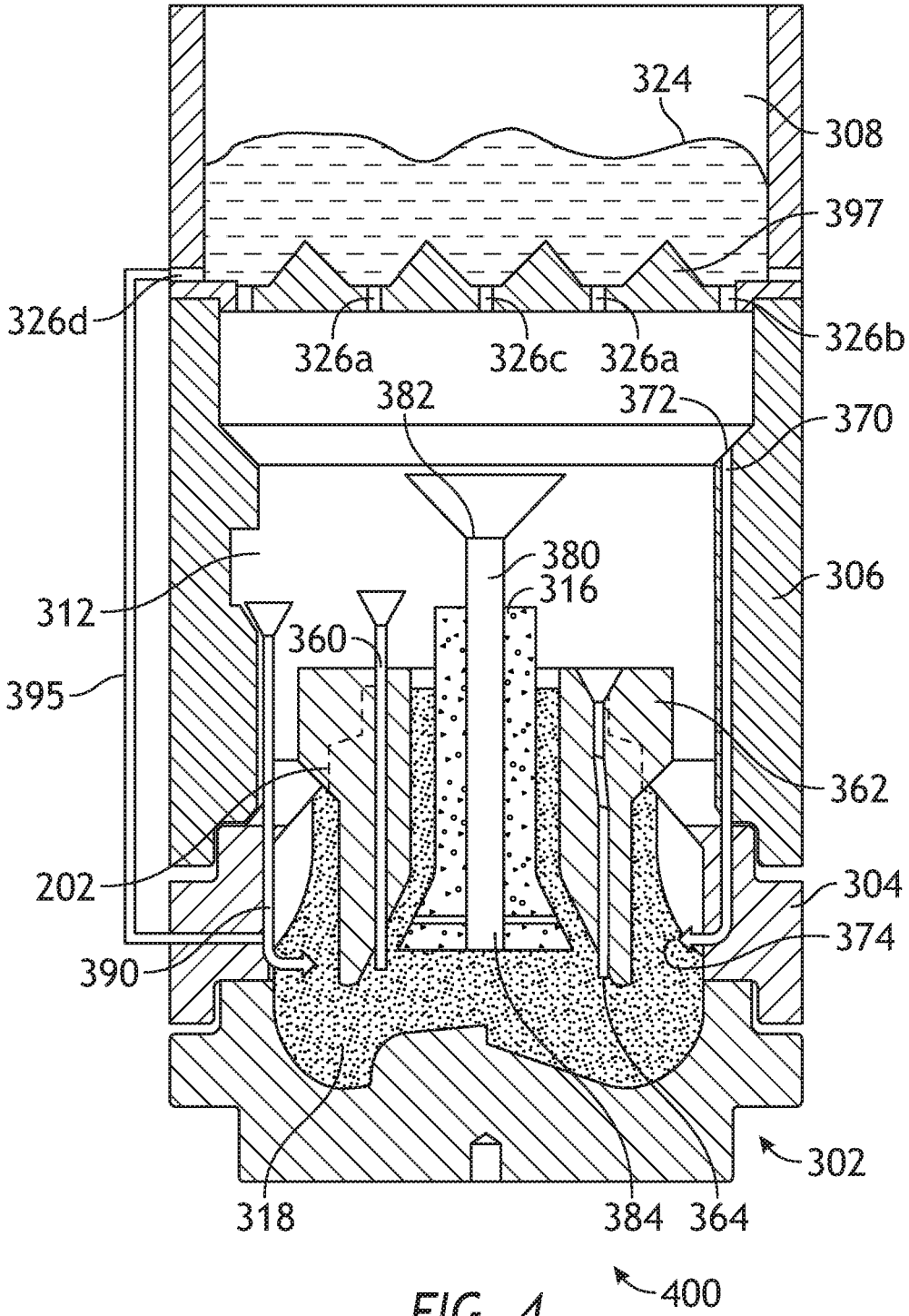
FIG. 4 is a cross-sectional view of a mold assembly including multiple binder flow channels, according to some embodiments.

FIG. 4 is a cross-sectional view of an exemplary mold assembly 400 including multiple binder flow channels. Similar components are labeled the same as in the mold assembly 300 of FIG. 3. In some aspects, the binder bowl 308 may include a corrugated surface on the inner bottom portion thereof to guide the binder material 324 into the apertures 326*a*, 326*b*, and 326*c*. As illustrated in FIGS. 3 and 4, the mold assembly 300, 400 may further include a second binder flow channel 370 having an inlet section 372 extending from below a second aperture 326*b* of the plurality of apertures in the binder bowl 308, through the funnel 306, and into the infiltration chamber 312 for delivery of the binder material 324 into the bottom of the mold assembly 330 for infiltration with the reinforcement material 318. Similar to the first binder flow channel 360, the second binder flow channel 370 may be formed by drilling a hole through the wall of the funnel 306 and/or the gauge ring 304 to define a funnel binder cavity configured to receive the binder material and facilitate communication between the funnel binder cavity and the infiltration chamber.

In some embodiments, the second binder flow channel 370 is further defined in at least one of the gauge ring 304 or the junk slot. For example, as illustrated in FIG. 4, the second binder flow channel 370 may extend from the inlet section 372 through the funnel 306 and the gauge ring 304, and into the bottom of the mold assembly 400. Additionally, or alternatively, the second binder flow channel 370 may extend from the inlet section 372 through the funnel 306 and the junk slot 124, and into the bottom of the mold assembly 400.

In accordance with some embodiments, the mold assembly 300 may further include a third binder flow channel 380 defined in the displacement core, and extending from the binder bowl 308 to the infiltration chamber 312 for the delivery of the binder material 324 to the powder reinforcement material 318 for the infiltrating. The third binder flow channel 380 may be formed by drilling a bore that extends through a center of the displacement core 316. In some embodiments, the third binder flow channel 380 is a sleeve made of at least one of a metal, graphite, or a ceramic material. That is, the third binder flow channel 380 may be formed by inserting a metal, graphite, and/or a ceramic piping or tubing through the bore in the center of the displacement core 316, as illustrated for example in FIG. 4. In some embodiments, a plurality of third binder flow channels may be inserted or formed in the displacement core 316 to increase the rate at which the binder material is delivered to the infiltration chamber 312.

In accordance with some embodiments, the mold assembly 400 may further include a fourth binder flow channel 395 extending out from an aperture 326*d* of the binder bowl 308 along an exterior of the mold assembly 400 and into the infiltration chamber 312 through the gage ring 304. The fourth binder flow channel 395 provides an additional path, which can be exterior to the mold assembly, through which the binder material 324 may be delivered to the infiltration chamber 312.

In some embodiments, the binder bowl 308 can comprise a contoured upper surface 397. The contoured upper surface 397 can define a raised or corrugated profile that forms a plurality of channels that taper toward bottom sections at which the apertures 326*a*, 326*b*, 326*c*, 326*d* are located. The channels can serve to funnel or direct binder material 324 into the apertures 326*a*, 326*b*, 326*c*, 326*d*. Thus, the contoured upper surface 397 can tend to ensure that the binder material 324 is efficiently directed through the apertures 326*a*, 326*b*, 326*c*, 326*d* and distributed throughout the mold assembly.

By providing the aforementioned first, second, and third binder flow channels in the blank, in the displacement core, and in the wall of the mold, respectively, the present invention provides the advantages of increasing the number of locations through which binder can be delivered to the infiltration chamber. In particular, the present invention provides the advantage that binder material is not only able to be delivered from the top of the infiltration chamber but instead additionally directly to the bottom of the mold assembly 300, that is, the infiltration chamber 312, for infiltration of the reinforcement materials 318.

In some embodiments, materials, such as consolidated sand or graphite, may be positioned within the mold assembly 300 at desired locations to form various features of the drill bit 100 (FIGS. 1 and 2). For example, nozzle displacement legs 314*a*, 314*b* may be positioned to correspond with desired locations and configurations of fluid flow passageways and their respective nozzle openings 122 (FIG. 1). Moreover, a cylindrically shaped consolidated displacement core 316 may be placed on the legs 314*a*, 314*b*. The number of legs 314*a*, 314*b* extending from the displacement core 316 will depend upon the desired number of flow passageways and corresponding nozzle openings 122 in the drill bit 100. Moreover, one or more junk slot displacements 315 may also be positioned within the mold assembly 300 to correspond with the junk slots 124 (FIG. 1).

After the desired materials (e.g., the central displacement 316, the nozzle displacements legs 314*a*, 314*b*, the junk slot displacement 315, etc.) have been installed within the mold assembly 300, reinforcement materials 318 may then be placed within or otherwise introduced into the mold assembly 300. For some applications, two or more different types of powder reinforcement materials 318 may be deposited in infiltration chamber 312 of the mold assembly 300.

The reinforcement materials 318 may include, for example, various types of reinforcing particles. Suitable reinforcing particles include, but are not limited to, particles of metals, metal alloys, superalloys, intermetallics, borides, carbides, nitrides, oxides, ceramics, diamonds, and the like, or any combination thereof.

Examples of suitable reinforcing particles include, but are not limited to, tungsten, molybdenum, niobium, tantalum, rhenium, iridium, ruthenium, beryllium, titanium, chromium, rhodium, iron, cobalt, uranium, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYNES® alloys (i.e., nickel-chromium containing superalloys available from Haynes International), INCOLOY® alloys (i.e., iron-nickel containing superalloys available from Mega Mex), MP98T (i.e., a nickel-copper-chromium superalloy available from SPS Technologies), TMS alloys, CMSX® alloys (i.e., nickel-based superalloys available from C-M Group), cobalt alloy 6B (i.e., cobalt-based superalloy available from HPA), N-155 alloys, any mixture thereof, and any combination thereof. In some embodiments, the reinforcing particles may be coated, such as diamond coated with titanium.

In operation, after a sufficient volume of the powder reinforcement materials 318 has been added to the mold assembly 300, the metal blank 202 may then be placed within mold assembly 300 and concentrically arranged about the displacement core 316. The metal blank 202 may include an inside diameter 320 that is greater than an outside diameter 322 of the displacement core 316, and various fixtures (not expressly shown) may be used to position the metal blank 202 within the mold assembly 300 at a desired location. The powder reinforcement materials 318 may then be filled to a desired level within the infiltration chamber 312.

Binder material 324 may then be placed on top of the reinforcement materials 318, the blank 202, and the central displacement 316. Suitable binder materials 324 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof.

Non-limiting examples of alloys of the binder material 324 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially available binder materials 324 include, but are not limited to, VIRGIN™ Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling; and any combination thereof.

In some embodiments, the binder material 324 may be covered with a flux layer (not expressly shown). The amount of binder material 324 (and optional flux material) added to the infiltration chamber 312 should be at least enough to infiltrate the reinforcement materials 318 during the infiltration process. In some instances, some or all of the binder material 324 may be placed in the binder bowl 308, which may be used to distribute the binder material 324 into the infiltration chamber 312 via various apertures 326*a*, 326*b*, 326*c*, 326*d* that extend therethrough. The cap 310 (if used) may then be placed over the mold assembly 300. The mold assembly 300 and the materials disposed therein may then be preheated and subsequently placed in a furnace (not shown). When the internal mold temperature reaches the melting point of the binder material 324, the binder material 324 will liquefy and proceed to infiltrate the reinforcement materials 318.

After a predetermined amount of time allotted for the liquefied binder material 324 to infiltrate the reinforcement materials 318, the mold assembly 300 may then be removed from the furnace and cooled at a controlled rate. Once cooled, the mold assembly 300 may be broken away to expose the bit body 108 (FIGS. 1 and 2). Subsequent machining and post-processing according to well-known techniques may then be used to finish the drill bit 100 (FIG. 1).

Figure 5:
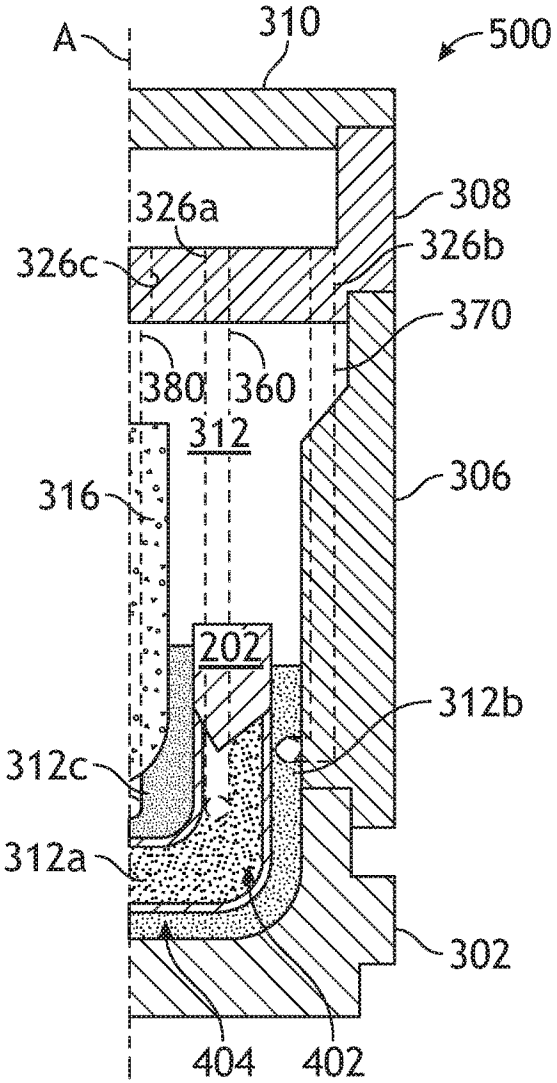
FIG. 5 is a partial cross-sectional side view of a mold assembly, according to some embodiments.

Referring now to FIG. 5, with continued reference to FIGS. 2A-4, illustrated is a partial cross-sectional side view of the exemplary mold assembly 500. For simplicity, only half of the mold assembly 500 is shown as taken along a longitudinal axis A of the mold assembly 500. Due to the asymmetric nature of straight-through cross sections for drill bits with an odd number of blades (e.g., FIG. 1), successive cross-sectional figures are restricted to half sections to illustrate simplified generalized configurations that are applicable to drill bits of varying numbers of blades in addition to different portions of drill bits, such as blade sections and junk-slot sections. Optionally, these half sections may be transferable from blade regions to junk-slot regions by simply adding the nozzle displacements legs 314*a*, 314*b* (FIG. 3) and/or junk-slot displacements 315 (FIG. 2B).

The mold assembly 500 may be similar in some respects to the mold assembly 300 and 400 of FIGS. 3 and 4, and therefore may be best understood with reference thereto, where like numerals represent like elements or components not described again. The mold assembly 500 may include some or all of the component parts of the mold assembly 300 of FIG. 3. For instance, as illustrated, the mold assembly 500 may include some or all of the mold 302, the funnel 306, the binder bowl 308, the first, second, and third binder flow channels 360, 370, and 380, and the cap 310. In some embodiments, while not shown in FIG. 5, the gauge ring 304 (FIG. 3) may also be included in the mold assembly 500. The mold assembly 500 may further include the metal blank 202, the displacement core 316, and one or more nozzle displacement legs 314*a*, 314*b*, as generally described above.

Some or all of the foregoing components of the mold assembly 500 are collectively referred to herein as the "component parts" of the mold assembly 500. Accordingly, each of the mold 302, the gauge ring 304 (FIG. 3), the funnel 306, the binder bowl 308, the cap 310, the displacement core 316, and the nozzle displacement legs 314*a*, 314*b* may be considered component parts of the mold assembly 500 and also component parts of any of the other mold assemblies described herein. While only two nozzle displacement legs 314*a*, 314*b* are shown in FIG. 3, several more nozzle displacement legs may optionally be employed.

Figure 6:
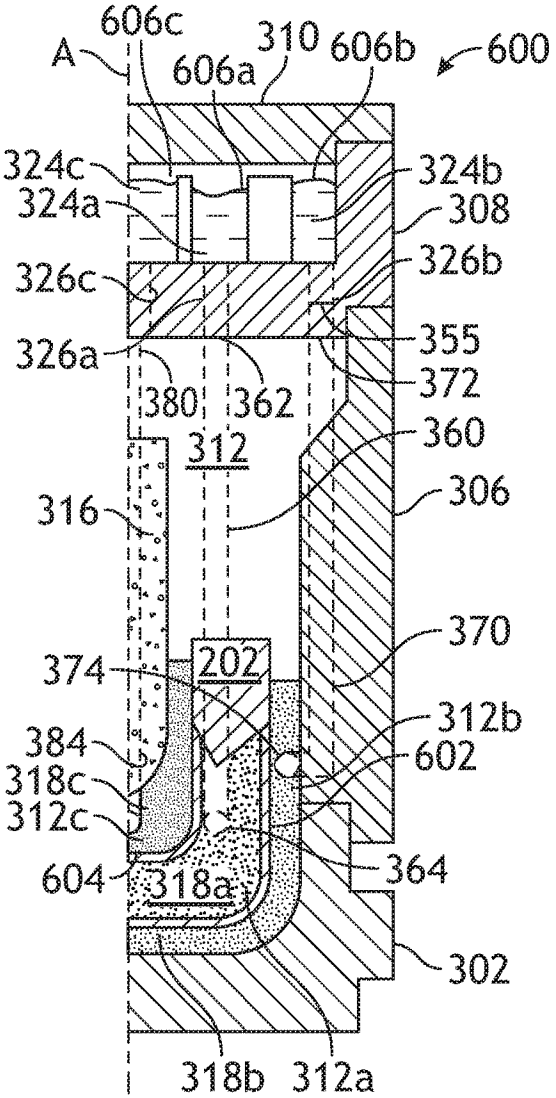
FIG. 6 is a partial cross-sectional side view of another mold assembly, according to some embodiments.

Referring now to FIG. 6, with continued reference to the prior figures, illustrated is a cross-sectional side view of another exemplary mold assembly 600. In some embodiments, the binder bowl 308 in the mold assembly 600 may be partitioned to define at least a first binder cavity 606*a*, a second binder cavity 606*b*, and a third binder cavity 606*c*. One or more first apertures 326*a*, one or more second apertures 326*b*, and one or more third apertures 326*c* may be defined through the binder bowl 308 to facilitate fluid communication between the first, second, and third binder cavities 606*a*, 606*b*, 606*c* and the first, second, and third zones 312*a*, 312*b*, 312*c* in the infiltration chamber, respectively.

In operation, a first binder material 324*a* may be positioned in the first binder cavity 606*a*, a second binder material 324*b* may be positioned in the second binder cavity 606*b*, and a third binder material 324*c* may be positioned in the third binder cavity 606*c*. During the infiltration process, the first, second, and third binder materials 324*a*, 324*b*, 324*c* may liquefy and flow into the first, second, and third zones 312*a*, 312*b*, 312*c* via the first, second, and third apertures 326*a*, 326*b*, 326*c*, respectively. Accordingly, the first binder material 324*a* may be configured to infiltrate the first composition 318*a*, the second binder material 324*b* may be configured to infiltrate the second composition 318*b*, and the third binder material 324*c* may be configured to infiltrate the third composition 318*c*.

In some embodiments, the mold assembly 600 may include a first boundary form 602 and a second boundary form 604 positioned within the infiltration chamber 312 and segregating the infiltration chamber 312 into at least a first zone 312*a*, a second zone 312*b*, and a third zone 312*c*. The first zone 312*a* is located at the center or core of the infiltration chamber 312, the second zone 312*b* is separated from the first zone 312*a* by the first boundary form 602, and the third zone 312*c* is separated from the first zone 312*a* by the second boundary form 604. Accordingly, the first and second boundary forms 602 and 604 may be offset from each other within the infiltration chamber 312, and the first zone 312*a* may generally interpose the second and third zones 312*b* and 312*c*.

During the loading and compaction processes, a first composition 318*a* may be loaded into the first zone 312*a*, a second composition 318*b* may be loaded into the second zone 312*b*, and a third composition 318*c* may be loaded into the third zone 312*c*. Accordingly, the boundary forms 602 and 604 may prove advantageous in facilitating segregated zones 312*a*, 312*b*, 312*c* that may be loaded with the same or different compositions or types of reinforcement materials 318 (FIG. 3), which may result in the first, second, and third zones 312*a*, 312*b*, 312*c* exhibiting different mechanical, chemical, physical, thermal, magnetic, or electrical properties following infiltration.

In at least one embodiment, as illustrated, the boundary forms 602 and 604 may be suspended within the infiltration chamber 312, such as by being coupled to the blank 202 or a sidewall of the infiltration chamber 312. In some embodiments, however, one or both of the boundary forms 602 and 604 may alternatively (or in addition thereto) include one or more ribs, standoffs, or protrusions (not shown) that support the boundary forms 602 and 604 within the infiltration chamber 312. In some embodiments, one or both of the boundary forms 602 and 604 may comprise impermeable structures that substantially prevent the compositions 318*a*, 318*b*, 318*c* from intermixing during the loading and compaction processes. In some embodiments, however, one or both of the boundary forms 602 and 604 may comprise generally permeable structures, as described above, and therefore able to allow an amount of intermixing of the compositions 318*a*, 318*b*, 318*c* during the loading and compaction processes and/or the infiltration process.

In operation, the first binder material 324*a* may be positioned in the first binder cavity 606*a*, the second binder material 324*b* may be positioned in the second binder cavity 606*b*, and the third binder material 324*c* may be positioned in a third (funnel) binder cavity 606*c*. During the infiltration process, the first and second binder materials 324*a*, 324*b* may liquefy and flow into the infiltration chamber 312 and, more particularly, into the first and second zones 312*a*, 312*b*, respectively through the first and second binder flow channels 360 and 370 respectively. Moreover, the third binder material 324*c* may liquefy and flow into the third zone 312*c* via the third binder flow channel 380 defined in the displacement core. As shown in FIG. 4, the first binder flow channel 360 extends from the first binder flow channel inlet section 362 to an outlet section 364 thereof positioned within the first zone 312*a* of the infiltration chamber 312 for infiltrating the powder reinforcement material 318*a* with the binder material 324*a*. As also shown in FIG. 4, the second binder flow channel 370 extends from the second binder flow channel inlet section 372 to an outlet section 374 thereof positioned within the second zone 312*b* of the infiltration chamber 312 for infiltrating the powder reinforcement material 312*b* with the binder material 324*b*. As illustrated in FIG. 6, the first and second zones are defined in a bottom portion of the mold assembly. Accordingly, the first binder material 324*a* may be configured to infiltrate the first composition 318*a*, the second binder material 324*b* may be configured to infiltrate the second composition 318*b*, and the third binder material 324*c* may be configured to infiltrate the third composition 318*c*.

The binder materials 324*a*, 324*b*, 324*c* may comprise any of the materials listed herein as suitable for the binder material 324 of FIG. 3. In some embodiments, however, one or more of the binder materials 324*a*, 324*b*, 324*c* may comprise different materials, which may result in the zones 312*a*, 312*b*, 312*c* exhibiting different mechanical, chemical, physical, thermal, magnetic, or electrical properties following infiltration. In such embodiments, one or more of the compositions 318*a*, 318*b*, 318*c* may be different from the others and otherwise not comprise the same type of reinforcing particles. Such an embodiment may prove advantageous in allowing an operator to selectively place specific materials at desired locations within and about the bit body 108 (FIGS. 1 and 2) and thereby obtain optimized mechanical, chemical, physical, thermal, magnetic, or electrical properties.

For example, the second zone 312*b* may encompass regions of the bit body 108 that include the blades 102 (FIG. 1). Accordingly, it may prove advantageous to place a particular composition 318*b* in the second zone 312*b* to be infiltrated with a particular binder material 324*b* that produces a material that is highly erosion-resistant or hard. Moreover, it may prove advantageous to place a particular composition 318*a* in the first zone 312*a* to be infiltrated with a particular binder material 324*a* that produces a material that is highly ductile. Furthermore, it may prove advantageous to place a particular composition 318*c* in the third zone 312*c*, which may be adjacent the inner bore and nozzle channels formed by the central displacement 316 and nozzle channel displacements 314*a*, 314*b* (FIG. 3), to be infiltrated with a particular binder material 324*b* that produces a material that has favorable compressive residual stresses.

While only two boundary forms 602 and 604 are depicted in FIG. 6, more than two may be employed, without departing from the scope of the disclosure. As will be appreciated, various boundary forms may be used and otherwise positioned in a generally horizontal or nested fashion, such that the bottom portion of a resulting MMC tool (e.g., a cutting region) is made using an erosion resistant material, and the material near the blank 202 may comprise a material that is tougher and/or more compatible with the material of the blank 202. Multiple horizontal or nested boundary forms may transition from the cutter region, which typically requires high erosion-resistance, to the bit-level region, which may be easily machinable. Accordingly, functionally graded material may be produced to greatly increase the level of customization possible in different regions of a given MMC tool.

In some embodiments, annular dividers (not shown) may be positioned in the infiltration chamber 312 to prevent the liquefied first, second, and third binder materials 324*a*, 324*b*, 324*c* from intermixing prior to infiltrating the first and second compositions 318*a*, 318*b*, 318*c*, respectively.

As illustrated in FIGS. 5 and 6, reproduced below, the funnel 306 of the mold assembly 600, however, may provide and otherwise define the second binder flow channel 370 extending therethrough, configured to receive the second binder material 324*b* and facilitate communication between the binder bowl 308 and the infiltration chamber 312 and, more particularly, between the binder bowl 308 and the second zone 312*b*.

In accordance with some embodiments, one or more plugs 355 (FIG. 6) may be disposed in at least one of the plurality of apertures 326 to selectively restrict flow of the binder material 324 through at least one of the first, second, or third binder flow channels 360, 370, and 380. The plug 355 can be formed of a material having a desired, predetermined melting point. In embodiments in which a plurality of plugs 355 is used, the predetermined melting points of at least two of the plugs 355 can be different from each other. Thus, in an assembly having a plurality of apertures configured to direct binder material to different sections of the mold, two or more of the apertures are occluded or blocked by a respective plug, the plug having the lowest melting point will melt first and open the corresponding aperture. Thus, the plugs can melt at different melting points and stagger the timing of when apertures permit flow of binder material to different sections of the mold, thus allowing the timing and flow characteristics of the assembly to be customized.

For example, if it is desired that a greater amount of binder material flow through the second binder channel 370 than the first and third binder flow channels 360 and 380 over a predetermined period of time (e.g., the time it takes for infiltration to take place), the aperture 326*b* may be disposed with a plug 355 having a lower melting point than plugs disposed in the first and/or third binder flow channels 360 and/or 380. When the mold assembly is heated, the plug 355 disposed in the second binder flow channel 370 will melt before the plugs disposed in the first and third binder flow channels 360 and 380, thereby causing binder material to flow from the second binder channel 370 until such time that melting points of the other plugs 355 are reached and the flow of binder material through the first and third binder channels 360 and 380 begins. Alternatively, at least one plug 355 may be disposed in at least one of the binder flow channels 360, 370, 380 so as to completely block or restrict binder material from flowing through the binder flow channel in which it is disposed.

Various examples of aspects of the disclosure are described as numbered clauses (1, 2, 3, etc.) for convenience. These are provided as examples and do not limit the subject technology. Identification of the figures and reference numbers are provided below merely as examples for illustrative purposes, and the clauses are not limited by those identifications.

Clause 1. A system for fabricating an infiltrated downhole tool for introduction into a wellbore, the system comprising: a mold assembly defining an infiltration chamber to receive and contain powder reinforcement material and a binder material used to form the infiltrated downhole tool, the mold assembly having: a binder bowl having a lower portion and a plurality of apertures extending through the lower portion; a mold defining a cavity disposed below the binder bowl and configured to receive the powder reinforcement material and permit infiltration of the powder reinforcement material with the binder material; a preformed blank disposed within the infiltration chamber to provide an attachment area for a body of the infiltrated downhole tool; and a funnel disposed intermediate the binder bowl and the mold; a binder flow channel having an inlet section disposed below an aperture of the plurality of apertures in the binder bowl, the binder flow channel extending through at least one of the preformed blank, the funnel, or a displacement core disposed within the mold assembly, the blank being concentrically arranged around the displacement core.

Clause 2. The system of Clause 1, wherein the binder flow channel extends through the preformed blank.

Clause 3. The system of Clause 2, wherein the binder flow channel comprises a metal sleeve disposed in the blank and extending from the binder bowl to the infiltration chamber for delivery of the binder material to the powder reinforcement material for infiltration.

Clause 4. The system of Clause 1, wherein the binder flow channel extends through the displacement core.

Clause 5. The system of Clause 4, wherein the binder flow channel extends from the binder bowl, through a center of the displacement core, and to the infiltration chamber for delivery of the binder material to the powder reinforcement material for infiltration.

Clause 6. The system of Clause 5, wherein the binder flow channel is defined by a bore extending through the displacement core.

Clause 7. The system of Clause 5, wherein the binder flow channel comprises a sleeve.

Clause 8. The system of Clause 7, wherein the sleeve comprises a metal, graphite, or ceramic material.

Clause 9. The system of Clause 1, wherein the binder flow channel extends through the funnel.

Clause 10. The system of Clause 9, further comprising: a gauge ring coupling the funnel to the mold; and a junk slot formed between adjacent pairs of cutter blades of the downhole tool, wherein the binder flow channel is further defined in the gauge ring or the junk slot.

Clause 11. The system of Clause 1, further comprising a second binder flow channel having an inlet section disposed below a second aperture of the plurality of apertures in the binder bowl.

Clause 12. The system of Clause 11, wherein the second binder flow channel extends through the funnel.

Clause 13. The system of Clause 11, wherein the first binder flow channel extends from the first binder flow channel inlet section to an outlet section thereof positioned within a first zone of the infiltration chamber for infiltrating the powder reinforcement material with the binder material, and wherein the second binder flow channel extends from the second binder flow channel inlet section to an outlet section thereof positioned within a second zone of the infiltration chamber for infiltrating the powder reinforcement material with the binder material, the first and second zones being defined in a bottom portion of the mold assembly.

Clause 14. The system of Clause 11, wherein the binder bowl is partitioned into first and second binder cavities, the first and second cavities each containing different binder materials, and wherein the aperture is disposed in the first binder cavity and the second aperture is disposed in the second binder cavity, the aperture and the second aperture providing fluid pathways from the first and second binder cavities to respective first and second zones in the infiltration chamber.

Clause 15. The system of Clause 1, further comprising a third binder flow channel extending from the binder bowl to the infiltration chamber for delivery of the binder material to the powder reinforcement material for infiltration.

Clause 16. The system of Clause 15, wherein the third binder flow channel extends through the displacement core.

Clause 17. The system of Clause 15, wherein the third binder flow channel comprises a sleeve.

Clause 18. The system of Clause 17, wherein the sleeve comprises a metal, graphite, or ceramic material.

Clause 19. The system of Clause 1, further comprising a plug disposed in one of the plurality of apertures to selectively restrict flow of the binder material through a corresponding binder flow channel.

Clause 20. The system of Clause 19, further comprising a plurality of plugs each having a predetermined melting point, the predetermined melting points of the plurality of plugs being different from each other.

Clause 21. A mold assembly for fabricating an infiltrated downhole tool, the mold assembly comprising: an infiltration chamber to receive and contain powder reinforcement material and a binder material used to form the infiltrated downhole tool; a binder bowl having a lower portion and a plurality of apertures extending through the lower portion; a plug positioned within a first aperture to occlude flow through the first aperture, the plug being configured to melt at a predetermined melting temperature to permit flow through the first aperture; and a mold defining a cavity disposed below the binder bowl and configured to receive the powder reinforcement material and permit infiltration of the powder reinforcement material with the binder material flowing through the first aperture after melting of the plug.

Clause 22. The assembly of Clause 21, further comprising a second plug positioned within a second aperture to occlude flow through the second aperture, the second plug being configured to melt at a second predetermined melting temperature to permit flow through the second aperture.

Clause 23. The assembly of Clause 22, wherein the second predetermined melting temperature of the second plug is different from the predetermined melting temperature of the plug.

Clause 24. The assembly of Clause 21, further comprising a preformed blank disposed within the infiltration chamber to provide an attachment area for a body of the infiltrated downhole tool.

Clause 25. The assembly of Clause 21, further comprising a funnel disposed intermediate the binder bowl and the mold.

Clause 26. The assembly of Clause 21, further comprising a binder flow channel having an inlet section disposed below an aperture of the plurality of apertures in the binder bowl, the binder flow channel extending through at least one of a preformed blank, a funnel, or a displacement core disposed within the mold assembly, the blank being concentrically arranged around the displacement core.

Clause 27. The assembly of Clause 26, wherein the binder flow channel extends through the preformed blank, the blank being concentrically arranged around the displacement core.

Clause 28. A method for forming an infiltrated downhole tool, the method comprising: depositing matrix reinforcement materials into an infiltration chamber of a mold assembly, the mold assembly including a binder bowl, a mold, a preformed blank, and a funnel, the binder bowl having a lower portion and a plurality of apertures extending through the lower portion, the mold defining a cavity disposed below the binder bowl and configured to receive a powder reinforcement material and permit infiltration of the powder reinforcement material with binder material, the preformed blank disposed within the infiltration chamber, and the funnel being disposed intermediate the binder bowl and the mold, the mold assembly further including a binder flow channel having an inlet section, the binder flow channel extending from below an aperture of the plurality of apertures in the binder bowl, through at least one of the preformed blank, the funnel, or a displacement core disposed within the mold assembly, the binder flow channel extending from the inlet section to an outlet section thereof; and delivering the binder material to the infiltration chamber through the binder flow channel to infiltrate the powder reinforcement material.

Clause 29. The method of Clause 28, wherein the binder flow channel extends through the preformed blank, and wherein the delivering comprises delivering the binder material through the preformed blank.

Clause 30. The method of Clause 28, wherein the binder flow channel extends through the displacement core, and wherein the delivering comprises delivering the binder material through the displacement core.

Clause 31. The method of Clause 28, wherein the binder flow channel extends through the funnel, and wherein the delivering comprises delivering the binder material through the funnel.

Clause 32. The method of Clause 28, further comprising, prior to the delivering of the binder material, heating the mold assembly until the binder material liquefies.

Clause 33. The method of Clause 28, wherein the delivering the binder material comprises channeling the binder material to at least one of a first zone, a second zone, or a third zone of the infiltration chamber through the binder flow channel formed in at least one of the preformed blank, the funnel, or the displacement core.

Clause 34. The method of Clause 28, wherein the assembly further comprises a plug disposed in a first aperture of the plurality of apertures to selectively restrict flow of the binder material through a corresponding binder flow channel, and the method further comprises melting the plug to permit flow through the first aperture.

Clause 35. The method of Clause 34, wherein the assembly further comprises a second plug disposed in a second aperture of the plurality of apertures to selectively restrict flow of the binder material through a second binder flow channel, and the method further comprises melting the second plug to permit flow through the second aperture.

Clause 36. The method of Clause 35, wherein the melting the plug comprises heating the plug to a first predetermined melting point, and the melting the second plug comprises heating the second plug to a second predetermined melting point, and wherein the first and second melting points are different from each other.

What is claimed is:

1. A system for fabricating an infiltrated downhole tool for introduction into a wellbore, the system comprising:

a mold assembly defining an infiltration chamber to receive and contain powder reinforcement material and a binder material used to form the infiltrated downhole tool, the mold assembly having:

a binder bowl having a lower portion and a plurality of apertures extending through the lower portion;

a mold defining a cavity disposed below the binder bowl and configured to receive the powder reinforcement material and permit infiltration of the powder reinforcement material with the binder material;

a preformed blank disposed within the infiltration chamber to provide an attachment area for a body of the infiltrated downhole tool; and a funnel disposed intermediate the binder bowl and the mold;

a binder flow channel having an inlet section disposed below an aperture of the plurality of apertures in the binder bowl, the binder flow channel extending through a wall of at least one of the preformed blank, the funnel, a displacement core, or a gauge ring disposed within the mold assembly, the blank being concentrically arranged around the displacement core.

2. The system of claim 1, wherein the binder flow channel extends through the preformed blank.

3. The system of claim 2, wherein the binder flow channel is defined by a tubing or piping extending through a hole formed in the blank.

4. The system of claim 1, wherein the binder flow channel extends through the displacement core.

5. The system of claim 4, wherein the binder flow channel is defined by a tubing or piping extending through the displacement core.

6. The system of claim 3 or 5, wherein the tubing or piping comprises metal, graphite, and/or a ceramic.

7. The system of claim 1, wherein the binder flow channel extends through the funnel.

8. The system of claim 7, further comprising:

the gauge ring coupling the funnel to the mold; and a junk slot formed between adjacent pairs of cutter blades of the downhole tool, wherein the binder flow channel is further defined in the gauge ring or the junk slot.

9. The system of claim 7, wherein the binder flow channel extends through the funnel and the gauge ring.

10. The system of claim 1, further comprising a second binder flow channel having an inlet section disposed below a second aperture of the plurality of apertures in the binder bowl.

11. The system of claim 10, wherein the first binder flow channel extends from the first binder flow channel inlet section to an outlet section thereof positioned within a first zone of the infiltration chamber for infiltrating the powder reinforcement material with the binder material, and wherein the second binder flow channel extends from the second binder flow channel inlet section to an outlet section thereof positioned within a second zone of the infiltration chamber for infiltrating the powder reinforcement material with the binder material, the first and second zones being defined in a bottom portion of the mold assembly.

12. The system of claim 10, wherein the binder bowl is partitioned into first and second binder cavities, the first and second cavities each containing different binder materials, and wherein the aperture is disposed in the first binder cavity and the second aperture is disposed in the second binder cavity, the aperture and the second aperture providing fluid pathways from the first and second binder cavities to respective first and second zones in the infiltration chamber.

13. The system of claim 1, further comprising a third binder flow channel extending from the binder bowl to the infiltration chamber for delivery of the binder material to the powder reinforcement material for infiltration.

14. The system of claim 1, further comprising a plug disposed in one of the plurality of apertures to selectively restrict flow of the binder material through a corresponding binder flow channel.

15. The system of claim 1, further comprising a second plug positioned within a second aperture to occlude flow through the second aperture, the second plug being configured to melt at a second predetermined melting temperature to permit flow through the second aperture.

16. The system of claim 15, wherein the second predetermined melting temperature of the second plug is different from the predetermined melting temperature of the plug.

17. The system of claim 1, wherein the binder bowl comprises a corrugated surface that forms a plurality of channels to guide the binder material into the plurality of apertures.

18. The system of claim 1, further comprising:

another binder flow channel exterior to the mold assembly.

19. The system of claim 1, wherein at least a portion of the binder flow channel is impermeable.

* * * * *